United States Patent [19]

Mougins

[11] 4,199,273

[45] Apr. 22, 1980

[54] DISCONTINUOUS PANELS FOR PROTECTING THE LOWER SURFACE OF A TABULAR ICEBERG AND METHOD OF INSTALLING SAME

[75] Inventor: Georges L. Mougins, Paris, France

[73] Assignee: ITI Limited, Paris, France

[21] Appl. No.: 893,072

[22] Filed: Apr. 3, 1978

[30] Foreign Application Priority Data

Apr. 14, 1977 [FR] France ..... 77 11278

[51] Int. Cl.[2] ..... E02B 1/00

[52] U.S. Cl. ..... 405/52; 405/61; 405/211

[58] Field of Search ..... 61/1 R, 1 F, 5; 405/52, 405/60, 61, 211

[56] References Cited

U.S. PATENT DOCUMENTS 3,289,415 12/1966 Merrill ..... 61/1 R

OTHER PUBLICATIONS

Ocean Industry, Mar. 1973, pp. 28–29.

*Primary Examiner*—David H. Corbin
*Attorney, Agent, or Firm*—George E. Kersey

[57] ABSTRACT

The panels are disposed in parallel to one another and are held in contact with the lower surface of a tabular iceberg by arms or cables attached to anchor points on the upper surface of the iceberg and by gas-filled chambers attached to the panels. The panels are stretched by ballast weights attached to their lower edges.

11 Claims, 3 Drawing Figures

DISCONTINUOUS PANELS FOR PROTECTING THE LOWER SURFACE OF A TABULAR ICEBERG AND METHOD OF INSTALLING SAME

The present invention concerns a discontinuous protective device for the substantially horizontal lower surface of a tabular iceberg, and a method for installing same. Tabular icebergs originate exclusively in the Antarctic where the ice does not advance in the form of tongues, but forms a plateau with a well-defined frontier where it meets the ocean. The Antarctic continent is not encircled by mountains, but is bordered by a rim of ice, part of which is supported on the continental shelf and the rest of which floats upon the suface of the ocean. Under the pressure of the ice island, this mass of ice is gradually pushed towards the sea, and from time to time tabular icebergs become detached from the ice plateau. These can have areas of several square kilometers.

These tabular icebergs can be towed to the coastal waters of the arid regions of the earth. Towing a rectangular tabular iceberg 3500 m × 750 m from the Antarctic to the northern hemisphere at a speed of 0.5 meters per second takes several months, however. The height of the submerged portion of a rectangular tabular iceberg is 6 to 8 times the height of the portion above sea level, and the total thickness of the iceberg may be some 250 to 300 meters. The lower surface of a tabular iceberg is therefore located in the region of the thermocline.

In the case of a stationary iceberg, transfer of heat between the substantially horizontal lower surface of the iceberg and the cold seawater is relatively insignificant, especially in view of the fact that the density gradient of seawater between 0° and 3° C. is in the same sense as the temperature gradient. No convection occurs in the layer of water directly beneath the substantially horizontal lower surface of the iceberg, and heat transfer is effected entirely by conduction.

If the iceberg is moving, however, even at such a low speed as 0.5 m/s, turbulence is generated and this disturbs the calm layer of water directly beneath the substantially horizontal lower surface of the iceberg, and favours transfer of heat. It is therefore important to keep away the turbulence generated by the movement of the iceberg, by a discontinuous protective device formed by vertical panels hanging beneath the substantially horizontal lower surface of the iceberg.

A discontinuous protective device is effective as long as the turbulence created by the movement of the iceberg at a speed of around 0.5 m/s is low in energy, so that it is dissipated over a distance of some 50 meters, after disturbing a layer of water 2 to 4 meters thick located above the edge responsible for the generation of the turbulence.

A discontinuous protective device in accordance with the invention consists in a series of vertical panels with their upper edges running right across the width of the substantially horizontal lower surface of the iceberg, the panels having a height h of 6 to 10 meters and being 4 to 8 meters apart, and having ballast weights attached to their lower edges. The turbulence created by the movement of the iceberg and originating at the lower edges of the panels is therefore dissipated before reaching the substantially horizontal lower surface of the iceberg. By the time the turbulence generated by each panel strikes the following panel it is considerably attenuated. Each panel is so ballasted that it cannot incline at an angle of more than 45° under the effect of the dynamic pressure of the warm seawater generated by the movement of the iceberg. The end result is that a layer of calm cold water is maintained between the substantially horizontal lower surface of the iceberg and the warm seawater in which the iceberg is floating.

The present invention is therefore intended to provide a discontinuous protective device for the protection of the substantially horizontal lower surface of a tabular iceberg, the device being formed of large panels. By way of example, these panels may be several hundred meters long and 6 to 10 meters high, due account being taken of the capacity of the floating storage and handling drums used to transport the panels from the manufacturing site to the iceberg. The invention is also concerned with the method of installing these panels beneath the iceberg.

The present applicants have described a method for making large films and woven materials which are directly wound onto a floating drum. In the case of a discontinuous protection device in accordance with the present invention, the panels are attached together by means of deployment arms which join together the upper edges of the panels. In the vicinity of these upper edges are located chambers which can be filled with air or a pyrotechnically generated gas. At each top corner of each of the protective panels is attached a suspension arm at least 300 meters long.

The protective panels in accordance with the present invention may be defined as of large dimensions, parallel to one another, and maintained in contact with the substantially horizontal lower surface of a tabular iceberg by suspension cables or arms attached to anchor points located on the substantially horizontal upper surface of the tabular iceberg and by chambers filled with gas attached to the protective panels. The panels are ballasted.

The protective panels are installed using two tugs. After standing the floating drum on which the protective panels are wound as soon as they are manufactured on end in the sea, the panels are unwoudd by one of the tugs while the other tug holds the drum in position. At the top corners of the protective panels (and therefore at regular intervals corresponding to the length of the deployment cables) there are attached suspension cables or arms, the length of these being greater than the height of the iceberg. Suspension arms are also fitted along the top edge of the first protective panel. The protective panels are maintained on the surface by strings of floats and by cables of variable length. The two tugs move to positions on either side of the iceberg, keeping the discontinuous protective device parallel to the substantially vertical rear face of the tabular iceberg. The suspension arms on the top edge of the first protective panel are attached to anchor points on the substantially horizontal upper surface of the tabular iceberg. The protective panels can then be lowered to such a depth that they are below the substantially horizontal lower surface of the tabular iceberg.

The protective panels can then be deployed by the tugs moving parallel to the iceberg at a distance greater than the depth to which the protective panels are submerged, so that the arms with one end attached to the protective panels and the other end attached to one of the tugs, directly or via a compensating chamber, assume the shape of a catenary curve. The whole is advanced parallel to the iceberg, which progressively deploys the discontinuous protective device beneath the substantially horizontal lower surface of the iceberg, one panel at a time, each panel being separated from the preceding one by a distance equal to the length of the deployment arms. Once a panel is aligned as required, due account being taken of the lengths of the deployment arms, a helicopter or some other conventional device is used to transfer the ends of the suspension arms attached to the tugs to the substantially horizontal upper surface of the iceberg, where they are attached to respective anchor points distributed over the iceberg's upper surface and located close to the edge. The operation continues until all the panels are correctly aligned. The arms along the edge of the final panel are finally attached to the corresponding anchor points on the substantially horizontal upper surface of the iceberg. The final stage in the installation of the protective panels is the filling of the chambers located along the upper edge of each panel with air or a pyrotechnically generated gas. These chambers located along the upper edge of each of the protective panels then bear against the lower surface of the iceberg.

In another version of the method for installing discontinuous protective panels in accordance with the invention, it may be preferable to fill the chambers with air or the pyrotechnically generated gas as each panel is deployed. It will be appreciated that the suspension arms must be shortened and the anchor point changed.

To sum up, the method for installing discontinuous protective panels in accordance with the invention is characterised by four stages: the panels are manufactured and rolled onto a drum, transported to the iceberg and unrolled with the roll stood on end, the panels being maintained on the surface of the sea by a string of floats while suspension arms attached to the edge and upper corners of each panel are attached to anchor points on the upper surface of the iceberg, the set of panels then being submerged and passed beneath the lower surface of the iceberg and the panels deployed one at a time, starting with the final panel, side arms attached to the upper corners of each panel being attached to anchor points on the upper surface of the iceberg, the arms attached to the upper edge of the first panel finally being attached to anchor points on the upper surface of the iceberg, the chambers attached to the panels being filled with gas to expel the seawater previously contained therein.

The invention will now be described in more detail and by way of example only, with reference to the accompanying diagrammatic drawings, in which.

Figure 1:
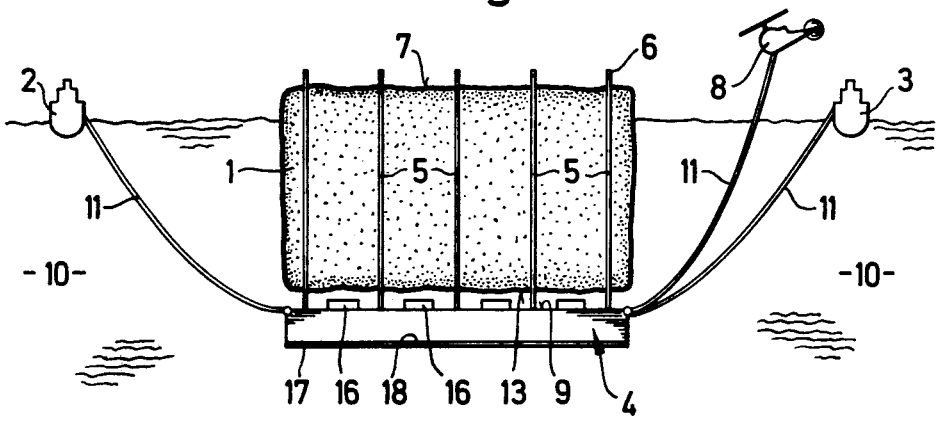
FIG. 1 shows the back of a tabular iceberg originating from the Antarctic, floating in the sea.
Figure 2:
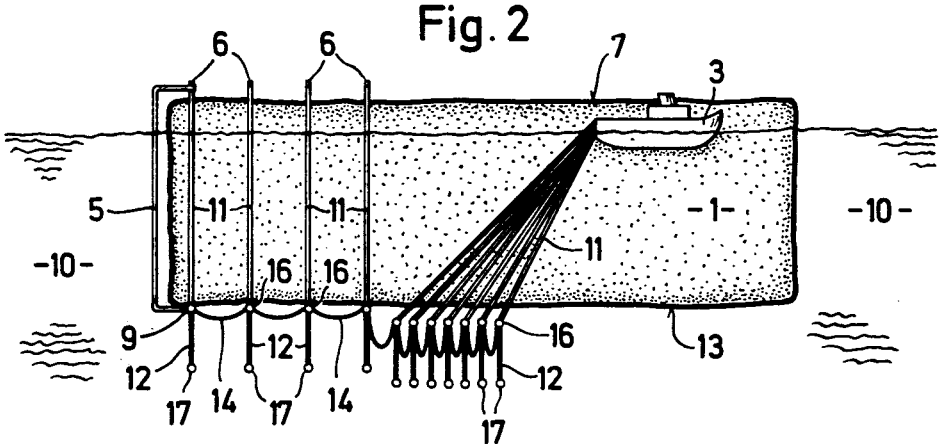
FIG. 2 is a side view of the iceberg shown in FIG. 1.

FIG. 1 shows the rear face of an iceberg (1) and two tugs (2) and (3), one on each side of the iceberg (1), towing a discontinuous protective device (4) which has been unwound from a storage and handling drum (not shown in the figure) onto which the protective panels are wound at the point of manufacture. The discontinuous protective device (4) is held beneath the substantially horizontal lower surface (13) of the iceberg (1) by suspension arms (5) attached to anchor points (6) along the periphery of the substantially horizontal upper surface (7) of the iceberg (1). The ends of these suspension arms (5) are attached to the top edge (9) of the final protective panel (12) as shown in FIG. 2. The lengths of the suspension arms (5) are greater than the thickness of the iceberg (1) so that the discontinuous protective device (4) can be engaged beneath the substantially horizontal lower surface (13) of the iceberg (1). The panels (12) are stretched by ballast weights (17) attached to their lower edge (18).

As the tugs (2) and (3) advance parallel to the iceberg (1) floating in the sea (10), the suspension arms (5) attached to the top edge (9) of the first protective panel (12) retain said panels (12) which make up the protective device (4), while the side suspension arms (11) attached to the top corners of each panel (12) and to the tugs (2) and (3) enable the discontinuous protective device (4) to be deployed, beginning with the rear panel of said discontinuous protective device (4), as shown in FIG. 2.

When the deployment cable or arm (14) located between two protective panels (12) is stretched tight, the side suspension arm (11) at the top corner is attached to the anchor point (6) located on the substantially horizontal upper surface (7) of the iceberg (1). The tugs (2) and (3) can then advance by the length of a deployment cable or arm (14) and proceed to attach the next side suspension arm (11). In practice, a helicopter (8) takes up each side suspension arm (11) and transports it to the upper surface (7) of the iceberg (1), where it is attached to an anchor point (6).

The same technique is used when unrolling the discontinuous protective device (4) for attaching the suspension arms (5) to the anchor points (6). When the storage and handling drum is stood on end one of the tugs (2) and (3) holds the drum, which floats in the sea, while the other tug unrolls the discontinuous protection device (4), which is held on the surface by a string of floats. The suspension arms (5) are then taken up by a helicopter (8). After attaching the suspension arms (5) to the anchor points (6), the discontinuous protective device (4) is submerged and placed beneath the substantially horizontal lower surface (13) of the iceberg (1).

Once the discontinuous protection device (4) is fully deployed parallel to the substantially horizontal lower surface (13) of the iceberg (1), air is blown into the chambers (16) located near the top edge (9) of each protective panel (12). The chambers, which are distributed along the entire length of the upper edges (9) of the protective panels (12), then bear against the substantially horizontal lower surface (13) of the iceberg (1).

It should be noted that the concepts of the front and rear faces of the iceberg have only been introduced in order to facilitate the understanding of the invention, and have no limiting function. It is also possible to use inflatable chambers.

Unlike certain protective devices used for icebergs from the Arctic, the function of the discontinuous protective device (4) is not to contain the freshwater resulting from the melting of the iceberg, but only to protect the substantially horizontal lower surface (13) of the iceberg (1) from the current of warm seawater produced by the movement of the iceberg (1) as it is moved by, for example, propulsion units (15) attached to the rear face of the iceberg (1) by means of a technique which has been described by the present applicants.

Figure 3:
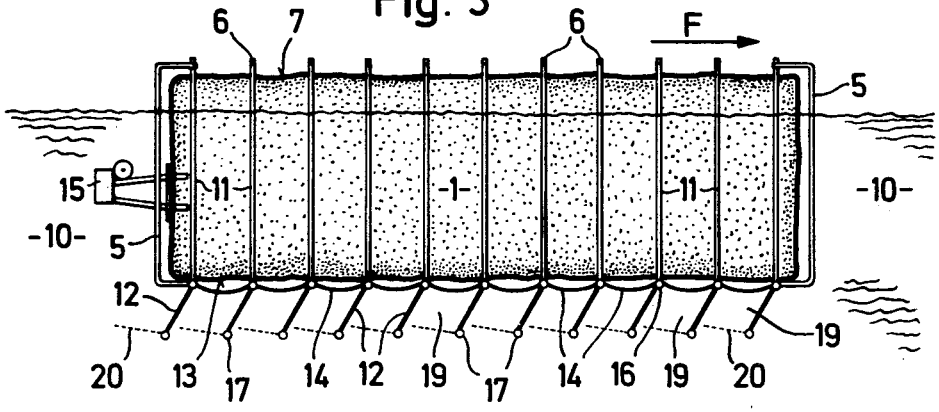
FIG. 3 is a side view of a tabular iceberg fitted with protective panels in accordance with the invention.

Thus FIG. 3, shows an iceberg (1) moving under the effect of propulsion units (15) fixed, for example, to the rear face of the iceberg (1). It moves in the direction shown by the arrow F. As a result the panels (12) are stretched between the chambers (16) near their upper edges and in contact with the substantially horizontal lower surface (13) of the iceberg (1) and the ballast weights (17) at their lower edges (18), the panels inclining as a result of the dynamic pressure exerted by the seawater (1). The turbulence created by the movement of the iceberg (1) at a speed of around 0.5 m/s is of low energy. The upper limit of the turbulent region is shown by the dashed line (20). Above this upper limit of the turbulent region, beneath the substantially horizontal lower surface (13) of the iceberg (1) and between the protective panels (12), are pockets of calm seawater (19) in which heat transfer is minimised.

The claims defining the invention are as follows:

1. A set of discontinuous panels for protecting the horizontal lower surface of a floating iceberg, wherein the panels are parallel to one another and are spaced apart extending across said horizontal lower surface from edge to edge, said panels being held below said lower surface by arms or cables attached to anchor points on the upper surface of the iceberg and by gas-filled chambers attached along the upper edges of the panels, with such panels stretched by ballast weights attached to their lower edges.

2. Apparatus as defined in claim 1 wherein the length of said arms exceeds the thickness of said floating iceberg.

3. Apparatus as defined in claim 1 wherein said anchor points are located in a substantially horizontal portion of the upper surface of said floating iceberg.

4. A method of installing a set of discontinuous panels extending from a first panel to a final panel, using suspension arms attached to the edge and upper corners of each panel and attached to anchor points on the upper surface of an iceberg, a set of panels then being submerged and passed beneath the lower surface of the iceberg and the panels deployed one at a time, starting with the final panel, side arms attached to the upper corners of each panel being attached to anchor points on the upper surface of the iceberg, the arms attached to the upper edge of the first panel finally being attached to anchor points on the upper surface of the iceberg, and chambers attached to the panels being filled with gas to expel the seawater previously contained therein.

5. A method according to claim 4 wherein the chambers attached to the panels are progressively filled with gas as the panels are deployed.

6. A method according to claim 4 wherein the panels have a spacing set by deployment arms when the set of panels is installed.

7. The method of claim 4 wherein said chambers are inflatable.

8. The method of claim 4 wherein said iceberg is propelled and said panels are stretched between said chambers and said ballast weights, with said panels inclining as a result of the dynamic pressure created by the seawater.

9. The method of claim 4 wherein said panels are deployed using two tug boats, one on each side of said panels.

10. The method of claim 4 wherein a helicopter takes each arm and transports it to the upper surface of the iceberg.

11. The method of claim 4 wherein the panels are manufactured and rolled onto a drum, transported to the iceberg and unrolled with the roll stood on end, the panels being maintained on the surface of the sea by a string of floats.

* * * * *